US007378648B2

(12) United States Patent
Wang et al.

(10) Patent No.: US 7,378,648 B2
(45) Date of Patent: May 27, 2008

(54) HIGH-RESOLUTION ION ISOLATION UTILIZING BROADBAND WAVEFORM SIGNALS

(75) Inventors: Mingda Wang, Fremont, CA (US); Doris Lee, Alamo, CA (US); Kenneth Newton, Concord, CA (US); Steve Schachterle, Martinez, CA (US)

(73) Assignee: Varian, Inc., Palo Alto, CA (US)

( * ) Notice: Subject to any disclaimer, the term of this patent is extended or adjusted under 35 U.S.C. 154(b) by 250 days.

(21) Appl. No.: 11/239,932

(22) Filed: Sep. 30, 2005

(65) Prior Publication Data

US 2007/0084994 A1 Apr. 19, 2007

(51) Int. Cl.
*H01J 49/26* (2006.01)

(52) U.S. Cl. ..... 250/282; 250/281; 250/290; 250/292; 250/293

(58) Field of Classification Search ..... 250/290, 250/292, 293, 281, 282
See application file for complete search history.

(56) References Cited

U.S. PATENT DOCUMENTS

| | | | | |
|---|---|---|---|---|
| 4,749,860 A | | 6/1988 | Kelley et al. | |
| 4,761,545 A | * | 8/1988 | Marshall et al. | 250/291 |
| 5,134,286 A | * | 7/1992 | Kelley | 250/282 |
| 5,179,278 A | | 1/1993 | Douglas | |
| 5,198,665 A | | 3/1993 | Wells | |
| 5,248,882 A | * | 9/1993 | Liang | 250/291 |
| 5,300,772 A | * | 4/1994 | Buttrill, Jr. | 250/282 |
| 5,324,939 A | * | 6/1994 | Louris et al. | 250/292 |
| 5,345,078 A | * | 9/1994 | Kelley | 250/282 |
| 5,381,007 A | | 1/1995 | Kelley | |
| 5,404,011 A | * | 4/1995 | Wells et al. | 250/282 |
| 5,449,905 A | * | 9/1995 | Hoekman et al. | 250/282 |
| 5,457,315 A | * | 10/1995 | Wells et al. | 250/282 |
| 5,466,931 A | | 11/1995 | Kelley | |
| 5,508,516 A | * | 4/1996 | Kelley | 250/282 |
| 5,521,380 A | * | 5/1996 | Wells et al. | 250/282 |
| 5,696,376 A | * | 12/1997 | Doroshenko et al. | 250/292 |
| 5,703,358 A | * | 12/1997 | Hoekman et al. | 250/282 |

(Continued)

FOREIGN PATENT DOCUMENTS

WO WO 2006/023252 3/2006

OTHER PUBLICATIONS

"The Scientist and Engineer's Guide to Digital Signal Processing", copyright © 1997-1998 by Steven W. Smith, Chapter 11, 6 pages including site contents and pp. 218-219.

*Primary Examiner*—Jack I. Berman
*Assistant Examiner*—Michael Maskell
(74) *Attorney, Agent, or Firm*—Bella Fishman; David P. Gloekler

(57) ABSTRACT

A desired ion is isolated in an ion trapping volume by applying an ion isolation signal to a plurality of ions in the ion trapping volume, including the desired ion to be retained in the ion trapping volume and an undesired ion to be ejected from the ion trapping volume. The ion isolation signal includes a plurality of signal components spanning a frequency range. The plurality of signal components includes a first component having a frequency near a secular frequency of the desired ion, and an adjacent component having a frequency adjacent to the frequency of the first component. The first component has an amplitude greater than the amplitude of the adjacent component.

24 Claims, 6 Drawing Sheets

U.S. PATENT DOCUMENTS 5,714,755 A * 2/1998 Wells et al. ..... 250/281
5,793,038 A * 8/1998 Buttrill, Jr. ..... 250/282
5,886,346 A 3/1999 Makarov
6,649,911 B2 11/2003 Kawato
6,710,336 B2 * 3/2004 Wells ..... 250/292
2002/0008199 A1 * 1/2002 Yoshinari et al. ..... 250/298
2003/0205667 A1 * 11/2003 Yoshinari et al. ..... 250/292
2006/0038123 A1 * 2/2006 Quarmby et al. ..... 250/292
2006/0219933 A1 * 10/2006 Wang ..... 250/396 R

* cited by examiner

HIGH-RESOLUTION ION ISOLATION UTILIZING BROADBAND WAVEFORM SIGNALS

FIELD OF THE INVENTION

The present invention relates generally to ion isolation waveform signals and their application to ion-containing volumes to isolate ions of a selected mass-to-charge ratio or range of mass-to-charge ratios from other ions present in the volume. The invention also relates to methods, systems, and apparatus for ion isolation in which the ion isolation signals may be utilized. The ion isolation signals may be employed, for example, in conjunction with mass spectrometry-related operations.

BACKGROUND OF THE INVENTION

Ion storage apparatus have been employed in a number of different applications in which control over the motions of ions is desired. In particular, ion storage apparatus have been utilized as mass analyzers or sorters in mass spectrometry (MS) systems. An ion storage apparatus includes an ion trap in which selected ions covering a wide range of differing mass-to-charge (m/z) ratios may be introduced or formed, stored for a desired period of time, and subjected to dissociation or other processes. Ions may also be selectively ejected from the ion trap to eliminate or detect the ejected ions, or to isolate other ions that are desired to be retained in the ion trap for additional study or processing. Depending on design, an ion trap may be established by electric and/or magnetic fields. Insofar as the present disclosure is concerned, the typical designs and operations of various types of ion storage apparatus, and various types of MS systems that employ ion storage apparatus, are generally known and need not be described in detail in the present disclosure.

In the operation of an ion storage device that provides an electric field-based ion trap, a radio frequency (RF) signal is applied to an electrode structure of the ion storage device to create an RF trapping field. The RF trapping field constrains the motions of ions along two or three dimensions to an ion trapping volume or region in the interior space of the electrode structure. A supplemental RF signal may also be applied to the electrode structure in combination with the main RF trapping signal to create a supplemental RF excitation field. The supplemental RF field may be utilized, among other purposes, to eject ions from the ion trapping volume for elimination or detection. In particular, the supplemental RF field may be utilized to eject unwanted ions from the ion trap and thereby isolate desired ions of a selected mass or range of masses in the ion trap. To isolate desired ions, it is possible to simultaneously eject all undesired ions over a range of differing m/z ratios from the ion storage apparatus by generating the excitation field from a supplemental RF signal having a broadband waveform. Moreover, the broadband waveform signal may have a notch in its frequency spectrum. Operating parameters may be set such that the secular frequency of a desired ion or ions falls within the bandwidth of the notch (the notch band). The notch band contains no signal components with a frequency corresponding to this secular frequency. Thus, the notch broadband waveform signal may be utilized to eject undesired ions whose masses are both greater and less than the mass of the desired ion, while the desired ion remains in the trap unaffected by this broadband signal and thus isolated from the ejected undesired ions.

The ion motion of two ions of different m/z ratios may be tightly coupled due to the characteristic or secular frequencies of the two ions being close to each other. This proximity of the secular frequencies of two different ions is problematic when a notch broadband waveform signal is applied to an ion storage apparatus to isolate an ion. Consider, for example, a plurality of ions that have been trapped in an ion storage apparatus. The ions include a desired ion having an m/z ratio of M, an undesired ion having an m/z ratio of M+1, and other ions having m/z ratios of M+i where i>1. A notch ejection waveform signal may be applied to the ion storage apparatus such that the secular frequency of the M ion falls in the frequency bandwidth of the notch (the notch band), the secular frequency of the M+1 ion falls outside the notch band but at or near the edge of the notch band, and the respective secular frequencies of the other M+i ions fall farther away from the notch band than the M+1 ion. More power is required to eject the M+1 ion than M+i ions. Conventionally, this requirement has been addressed by applying the entire composite waveform signal at a high enough average power to effectively eject the M+1 ion and thus separate the M+1 ion from the M ion. This means, however, that the high power is also employed to eject the more remote M+i ions. Unfortunately, this high power tends to reduce the effective bandwidth of the notch and consequently reduce the mass resolution. Moreover, the higher power required to effectively eject the M+1 ions is not likewise required to eject the other undesired (M+i) ions whose masses are more remote from the desired M ion.

In view of the foregoing, it would be advantageous to provide ion isolation waveform signals that are better tailored to isolate desired ions from undesired ions and do not require as much power as previously applied isolation waveform signals. These improved isolation waveform signals would provide high power only where it is needed—at frequencies at or close to the secular frequency corresponding to the desired ion to be isolated for use in resonantly ejecting ions of m/z ratios close to that of the desired ion, but not at the frequencies associated with undesired ions whose m/z ratios are more remote to that of the desired ion. In this manner, desired ions could be efficiently isolated from undesired ions while mass resolution is improved or at least not degraded, and the ion isolation signals could be applied with less average power than conventionally required.

SUMMARY OF THE INVENTION

To address the foregoing problems, in whole or in part, and/or other problems that may have been observed by persons skilled in the art, the present disclosure provides methods, systems, apparatus, and/or devices and for isolating ions, as described by way of example in implementations set forth below.

According to one implementation, a method is provided for isolating a desired ion in an ion trapping volume. An ion isolation signal is applied to a plurality of ions in the ion trapping volume, including a desired ion to be retained in the ion trapping volume and an undesired ion to be ejected from the ion trapping volume. The ion isolation signal includes a plurality of signal components spanning a frequency range. The plurality of signal components includes a first component having a frequency near a secular frequency of the desired ion, and an adjacent component having a frequency adjacent to the frequency of the first component. The first component has an amplitude greater than the amplitude of the adjacent component by a factor ranging from about 1.1 to 6.

According to another implementation, the ion isolation signal includes a plurality of signal components spanning a frequency range. The frequency range includes a lower frequency band, an upper frequency band, and a notch band separating the lower frequency band and the upper frequency band. The plurality of signal components includes a first component and an adjacent component. The first component has a first frequency near a secular frequency of the desired ion, outside the notch band at an edge of the notch band. The adjacent component has an adjacent frequency in the same frequency band as the first frequency and adjacent to the first frequency relative to the other signal components in the same frequency band. The first frequency has an amplitude greater than the amplitude of the adjacent component. The lower frequency band or the upper frequency band may include the first component.

According to another implementation, the first frequency is in the lower frequency band and at a first edge of the notch band. The plurality of signal components further includes a second component and a proximal component. The second component has a second frequency near a secular frequency of the desired ion, outside the notch band at a second edge of the notch band. The proximal component has a proximal frequency in the upper frequency band and adjacent to the second frequency relative to the other signal components in the upper frequency band. The second frequency has an amplitude greater than the amplitude of the proximal component.

According to another implementation, an apparatus is provided for isolating a desired ion in an interior. The apparatus comprises an electrode arrangement having an interior. The apparatus further comprises means for applying an ion isolation signal to the electrode structure to impart an RF excitation field to a plurality of ions in the interior, including a desired ion to be retained in the interior and an undesired ion to be ejected from interior. The ion isolation signal includes a plurality of signal components spanning a frequency range. The plurality of signal components includes a first component having a frequency near a secular frequency of the desired ion, and an adjacent component having a frequency adjacent to the frequency of the first component relative to the other signal components. The first component has an amplitude greater than the amplitude of the adjacent component by a factor ranging from about 1.1 to 6.

DETAILED DESCRIPTION OF THE INVENTION

Figure 1:
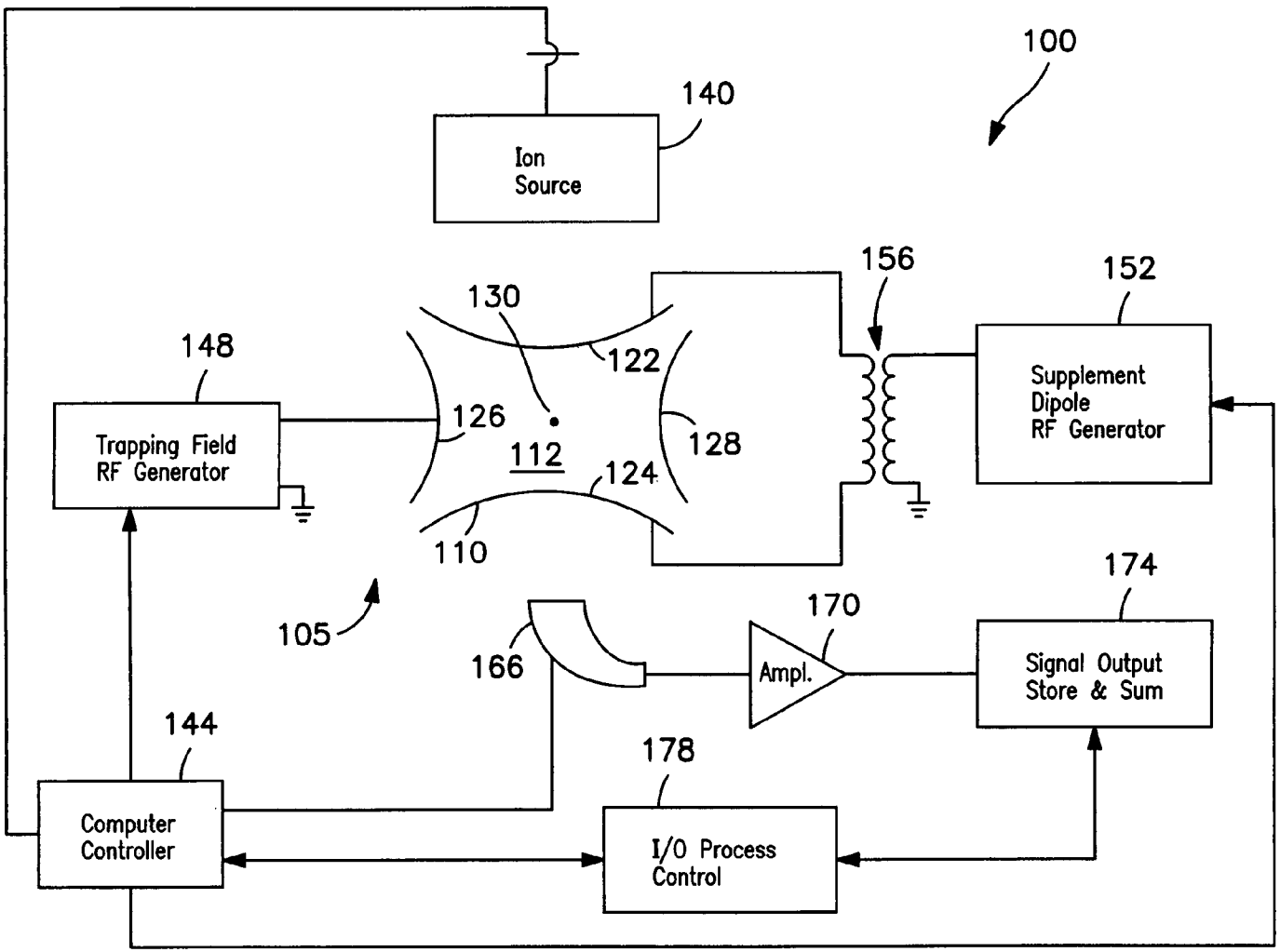
FIG. 1 is a schematic diagram illustrating a three-dimensional or two-dimensional ion storage device in cross-section and associated components and circuitry as one example of an operating environment in which ion isolation waveform signals described in the present disclosure may be applied.

The term "mass-to-charge" is often expressed as m/z, m/e, or m/q, or simply "mass" given that the charge number often has a value of 1. Accordingly, for purposes of the present disclosure, terms such as "m/z ratio" and "mass" are treated equivalently and used interchangeably unless otherwise indicated.

As used herein, the term "desired ion" refers to an ion of a given mass that is selected to be isolated in a given space, such as in a volume provided by an ion storage apparatus, from other ions of different masses. No limitation is placed on the purpose for isolating the desired ion. In some applications, the desired ion may be isolated to facilitate subsequent dissociation of the desired ion into smaller ions, for example as part of a tandem MS (MS/MS or $MS^n$) analysis. In other applications, the desired ion may be isolated to facilitate the study of reactions, ion-molecule interactions, gas-phase ion chemistry, or the like that may involve the desired ion. In many of these applications, the desired ion has been referred to in the literature as a "parent" ion or "precursor" ion.

As used herein, the term "undesired" ion, "unwanted" ion, or "rejected" ion refers to an ion of a given mass that is selected to be eliminated or ejected from a given space, such as in a volume provided by an ion storage apparatus, often as part of a process for isolating a desired ion or ions. Depending on the experiment being performed, an ejected undesired ion may be discarded or may be detected. More generally, however, no limitation is placed on the purpose for ejecting the undesired ion.

In general, the term "communicate" (for example, a first component "communicates with" or "is in communication with" a second component) is used herein to indicate a structural, functional, mechanical, electrical, optical, magnetic, ionic or fluidic relationship between two or more components (or elements, features, or the like). As such, the fact that one component is said to communicate with a second component is not intended to exclude the possibility that additional components may be present between, and/or operatively associated or engaged with, the first and second components.

The subject matter disclosed herein generally relates to the generation and application of ion isolation waveform signals. The ion isolation waveform signals may be applied to any suitable electrode structure to generate an ion-isolating electric field in a space contained between opposing electrodes of the electrode structure. As such, the ion isolation waveform signals may be applied to an ion storage apparatus to which an ion trapping field has also been applied. The ion isolation waveform signals may be applied as part of a mass spectrometric procedure. Accordingly, an ion storage apparatus in which the ion isolation waveform signals are applied may be operated in conjunction with a suitable mass spectrometry system. However, the various applications of the ion isolation waveform signals described in the present disclosure are not limited to these types of procedures, apparatus, and systems. Examples of ion isolation waveform signals and their implementations in apparatus and methods are described in more detail below with reference to FIGS. 1-10.

As previously noted, an ion storage apparatus may be used to constrain the motions of ions having a range of differing m/z ratios such that these ions are stably trapped and stored for a desired period of time. An example of an ion storage apparatus is described below and illustrated in FIG. 1. In use, an RF trapping signal may be applied to the electrode structure of the ion storage device to generate an RF trapping field in the interior space defined by the inward-facing surfaces of the electrodes of the electrode structure. In a typical but non-limiting implementation, the electrode structure is configured as a quadrupole ion trap with three main electrodes as described below. The resulting, quadrupolar RF trapping field traps ions having a range of differing m/z ratios. Initially, depending on the parameters of the RF trapping field and the ion storage apparatus, ions present in the ion storage apparatus whose m/z ratios fall outside the trapping range (the range affected by the RF trapping field) cannot be constrained by the trapping field are hence are eliminated from the ion storage apparatus, thereby leaving the remaining ions stored in the trapping field. The ions that remain trapped may include desired ions having one or more selected m/z ratios and undesired ions having other m/z ratios.

Certain experiments require that ions (desired ions) of a selected m/z ratio or ratios be retained in the ion storage apparatus for further study or procedures, and that the remaining undesired ions having other m/z ratios be removed from the ion storage apparatus. To accomplish this, a technique may be implemented by which the desired ions are isolated from the undesired ions. For example, an additional, supplemental RF isolation signal may be applied to the electrode structure to generate an RF excitation field (or RF isolation field) in the interior space of the electrode structure. The supplemental RF signal is typically applied to a pair of opposing electrodes of the electrode structure to generate a periodic supplemental RF dipole field in the interior space between these two opposing electrodes. The supplemental RF signal ejects undesired ions of selected m/z values from the trapping field by resonant excitation along the axis on which the two opposing electrodes lie. The mechanisms of resonant excitation, and the various techniques for ejecting ions through resonance excitation, are well-known and thus need not be described in detail in the present disclosure. Here, it will be noted only that an undesired ion is ejected when its secular frequency equals or approximates the frequency of the supplemental RF signal, assuming the supplemental RF signal provides enough power at this resonance condition for the undesired ion to overcome the restoring force imparted by the trapping field. On the other hand, the secular frequency of the desired ion is such that the desired ion is not brought into resonance with the excitation field. As a result, the desired ion remains trapped in the ion trap while the undesired ion is ejected.

The supplemental RF signal employed for ion isolation may be a broadband frequency waveform signal. This broadband waveform signal may be utilized to generate an excitation field that is effective to resonantly eject a mass range of undesired ions simultaneously from the ion trap. The broadband waveform signal spans a frequency domain that includes frequency component signals (i.e., "frequency components," "component signals" or "signal components" at certain frequencies) corresponding to the secular frequencies of various undesired ions to be ejected. The broadband waveform signal may include a notch band interposed between a lower frequency band and an upper frequency band. Such a notch waveform signal may be utilized to eject undesired ions having masses both above and below the mass or masses of the desired ion or ions. As previously noted, broadband waveform signals employed for ion isolation in the prior art have exhibited inefficient isolation and poor mass resolution.

Methods and apparatus disclosed herein address such problems attending ion isolation techniques of the prior art by providing ion isolation waveform signals that are specifically tailored to provide high power only where it is needed—at the frequency components utilized to resonantly eject undesired ions whose masses are closest to the mass of the desired ion to be isolated. In some implementations, the ion isolation waveform signal is a broadband waveform signal covering a range of frequencies. The value of the secular frequency of a desired ion may be close to the value of the frequency of the signal component that is near one of the edges of the broadband waveform signal, but this secular frequency is not within the range of frequencies spanned by the broadband waveform signal. In these implementations, the higher power is provided only at one or more signal components whose frequencies are located at the edge of the broadband waveform signal. This edge of the broadband waveform signal is adjacent to the secular frequency of the desired ion to be isolated. In other implementations, the ion isolation waveform signal is a notched broadband frequency waveform signal. In such implementations, the higher power is applied only at one or more signal components whose frequencies are located at one or both edges of the notch band. The value of the secular frequency of the desired ion falls within this notch band, i.e., is between the edges of the notch band.

In the isolation waveform signals disclosed herein, the higher power is provided by increasing the amplitude of one or more selected frequency components of the composite waveform signal. Accordingly, the amplitude of a signal component having a frequency at (next to, near, or adjacent to) the edge of the broadband signal (or, in the case of a notch broadband signal, at the edge of the notch band of the signal) is greater than the amplitudes of the signal components having frequencies farther away from the notch band. In some implementations, the relatively higher amplitude of the selected signal component is produced by weighting the amplitude, such as by multiplying the amplitude of the signal component by a weight factor. Examples of tailored ion isolation waveform signals generated in accordance with these principles are described below and include the ion isolation waveform signals illustrated in FIGS. 2-6.

When an ion isolation signal is applied with a waveform of the type described in the present disclosure, the average power of the entire ion isolation signal can be reduced as compared to ion isolation signals of the prior art and, in the case of a notch waveform signal, the proper effective width of the notch band can be maintained. In practice, the ion isolation signals described in the present disclosure ensure that (1) most or all desired ions—that is, most or all ions intended to be trapped in an ion trapping volume and thereafter retained in the ion trapping volume for purposes of isolation—do in fact remain trapped as a result of application of the ion isolation signal; and (2) most or all undesired ions—that is, most or all ions whose secular frequencies lie just outside the notch window or broadband edge as well as all other ions whose secular frequencies lie within the broadband—are in fact ejected. Moreover, the ion isolation signals described in the present disclosure provide improved mass resolution and require less overall power.

FIG. 1 illustrates one implementation of a mass spectrometry (MS) apparatus or system 100 as an example of one type of operating environment in which the isolation waveform signals disclosed herein may be applied. The MS apparatus 100 may include an ion storage apparatus 105 of any suitable type and associated circuitry. In the example specifically illustrated in FIG. 1, the ion storage apparatus 105 is a quadrupole ion trap and thus includes a quadruploar electrode structure defining an ion trap 110. As illustrated by way of cross-section in FIG. 1, the ion trap 110 is formed by four hyperbolically-shaped, electrically conductive surfaces arranged such that two opposing pairs of surfaces face inwardly toward each other, thereby defining a central interior space 112 of the ion trap 110 suitable for containing an ion trapping volume or region. From the perspective of FIG. 1, the ion trap 110 comprises a top electrode 122 and an opposing bottom electrode 124, and two opposing side electrodes 126 and 128.

The configuration of the ion trap 110 depicted in FIG. 1 may be either three-dimensional or two-dimensional. That is, in one implementation, the top electrode 122 may be an upper end cap electrode, the bottom electrode 124 may be a lower end cap electrode, and the side electrodes 126 and 128 may be part of a continuous ring electrode instead of being physically separate electrodes. The geometric center of the interior space 112 of the ion trap 110 is indicated at point 130. In another implementation, the top electrode 122 may be an elongated upper electrode, the bottom electrode 124 may be an elongated lower electrode, and the side electrodes 126 and 128 may be elongated side electrodes. The elongation occurs in a direction along a central longitudinal axis of a two-dimensional ion trap. From the perspective of FIG. 1, the central longitudinal axis is directed into the drawing sheet and is represented by the point 130. The interior space 112 of the two-dimensional type of ion trap 110 is thus also elongated along the longitudinal axis 130. For convenience, the ion trap 110 illustrated in FIG. 1 will be described primarily in the context of a three-dimensional configuration (ring and end cap arrangement) with the understanding that a two-dimensional (or linear) configuration is applicable as well.

The MS apparatus 100 may include an ionization device 140 for providing or introducing sample ions in the interior space 112 of the ion trap 110. In the present context, the terms "providing" and "introducing" are intended to encompass the use of either an internal (in-trap) ionization technique or an external ionization technique. Internal and external ionization techniques of various types are well-known to persons skilled in the art and thus need not be described in detail in the present disclosure. The ionization device 140 illustrated in FIG. 1 may be an external ionization interface that ionizes a sample material and then directs the resulting ion stream into the ion trap 110. In other implementations, a stream of sample molecules are directed into the ion trap 110, and the device 140 directs a beam of energy into the ion trap 110 to ionize the sample molecules.

The MS apparatus 100 may also include any suitable electronic control device or system (or electronic controller) 144 for carrying out various functions and controlling various components of the MS apparatus 100. As a general matter, the electronic controller 144 in FIG. 1 is a simplified schematic representation of an electronic or computing operational system for the MS apparatus 100. As such, the electronic controller 144 may include, or be part of, a computer, microcomputer, microprocessor, microcontroller, analog circuitry, or the like as those terms are understood in the art. The electronic controller 144 may represent or be embodied in more than one processing component. For instance, the electronic controller 144 may comprise a main controlling component such as a computer in combination with one or more other processing components that implement more specific or dedicated functions. The electronic controller 144 may, for instance, control voltage sources, signal generators, oscillators, frequency synthesizers, or the like to implement waveform parameters and synthesis, frequency mixing, clocking and timing, phase locking, and the like as needed for applying the ion isolation waveform signals described in the present disclosure as well as signals employed for other purposes. The electronic controller 144 may have both hardware and software attributes. The electronic controller 144 may be adapted to execute instructions embodied in computer-readable or signal-bearing media for implementing one or more algorithms, methods or processes described in the present disclosure, or portions or subroutines of such algorithms, methods or processes. The instructions may be written in any suitable code, one example being C. The electronic controller 144 may include input interfaces for receiving commands and data from a user of the MS apparatus 100, and output interfaces for communicating with readout/display means (not shown).

The MS apparatus 100 may include one or more voltage sources as necessary to perform a variety of ion-controlling functions. As examples, one or more voltage sources may be employed to produce a main or fundamental RF trapping field for confining and storing ions in the ion trap 110, as well as to produce one or more supplemental RF fields that cooperate with the trapping field to implement tasks based on or enhanced by resonant excitation, including isolating ions, promoting dissociation or fragmentation of ions, ejecting ions for detection or elimination, and facilitating gas-phase ion chemistry.

Thus, in the example given by FIG. 1, the MS apparatus 100 includes a main RF waveform signal generator 148 that is electrically connected, for instance, to the ring electrode or electrode pair 126, 128 of the ion trap 110. The main RF waveform signal generator 148 may be utilized to apply an ion trapping signal to the ion trap 110 to produce a quadrupolar RF trapping field within the ion trap 110. The electronic controller 144 may communicate with the main RF waveform signal generator 148 to control the amplitude, frequency, and phase of the ion trapping signal as needed as well as the timing of its application.

Also in the example given by FIG. 1, the MS apparatus 100 includes one or more supplemental RF waveform signal generators 152 electrically connected, for instance, to the top and bottom electrodes 122 and 124 of the ion trap 110 to produce a dipolar excitation field between this opposing pair of electrodes 122 and 124. In some implementations, the supplemental RF waveform signal generator 152 is a broadband multi-frequency waveform signal generator. In the present example, the supplemental RF waveform signal generator 152 is coupled to the ion trap 110 through a transformer 156, although the supplemental RF waveform signal generator 152 may communicate with the ion trap 110 via any suitable means. Depending on the function being performed, the voltage signal applied by the supplemental RF waveform signal generator 152 may be a single, fixed-frequency signal or, in the case of the isolation waveform signals described below, may include an ensemble of discrete signal components of differing frequencies (i.e., a collection of different frequency component signals). The electronic controller 144 may communicate with the supplemental RF waveform signal generator 152 to control various operating parameters of the supplemental RF signals, such as amplitudes, frequencies, frequency intervals, timing, and the like.

It will be understood that addition to ion isolation, dipolar or monopolar RF excitation fields may be employed for other purposes, such as to promote reactions involving isolated ions, perform tandem MS procedures, enable mass-selective ejection of ions, and the like. For such tasks that do not coincide with ion isolation, the same supplemental RF waveform signal generator 152 may be utilized for different tasks. Otherwise, it will be understood that additional supplemental RF signal generators (not shown) may be coupled to the ion storage apparatus 105.

As appreciated by persons skilled in the art, the ion isolation waveform signals described in the present disclosure as well as other supplemental waveform signals may be created, for instance, by utilizing electronic controller 144 to execute a software program that computes the waveform parameters and creates a data file whose contents are loaded into random-access memory (RAM) and then clocked out into a digital-to-analog converter (DAC). The software may be employed to construct the ion isolation signals described below that are optimized for a given MS experiment. The software may be transferred to or loaded into the electronic controller 144 by any suitable wired or wireless means. For purposes of the present disclosure, the software may be considered as residing within the electronic controller 144 schematically depicted in FIG. 1.

As an example of operating the MS apparatus 100, ions of differing m/z values are provided or introduced in the ion trap 110 by performing an internal or external ionization technique. The main RF waveform signal generator 148 is operated to apply a quadrupolar trapping field to the ion trap 110 to trap all ions or ions of a trappable range of m/z values. While the trapping field is active, and during or after ionization of sample material in the ion trap 110 or introduction of ions into the ion trap 110, the supplemental RF waveform signal generator 152 is operated to isolate desired ions of selected masses or mass ranges in the ion trap 110. To perform the isolation step, the supplemental RF waveform signal generator 152 applies an RF signal according to any of the ion isolation waveform signals described below. The ion isolation waveform signal produces an excitation field that, in combination with the trapping field, causes all undesired ions to be resonantly ejected from the ion trap 110. The isolated ion or ions may thereafter be subjected to any appropriate processing such as dissociation, reaction, and the like. After isolation or further processing, any ions remaining in the ion trap 110 may be ejected from the ion trap 110 by means of any suitable ejection technique known to persons skilled in the art such as, for example, resonance ejection through the use of a fixed, single-frequency dipolar excitation field and a selected scanning strategy. The ejected ions travel along an intended direction (for example, the axis of the applied excitation field dipole) to a suitable ion detector 166 that may be either externally or internally positioned relative to the ion trap 110.

The output signals generated by the ion detector 166 may be processed by any suitable means as needed to yield a mass spectrum informative of the analyte sample processed by the MS apparatus 100. By way of example only, FIG. 1 illustrates various post-detection processing functions or circuitry operating under the control of the electronic controller 144, including an amplifier 170, signal output store and sum circuitry 174, and an input/output (I/O) process control 178. Generally, components and techniques for acquiring and processing data, conditioning signals, and displaying spectral information are well known to persons skilled in the art and thus need not be described in further detail.

In the operation of an ion storage apparatus such as the ion storage apparatus 105 described above and illustrated in FIG. 1, the isolation of a desired ion from undesired ions may be optimized or improved by applying an ion isolation waveform signal that is tailored such that the amplitude(s) of one or more frequency component signals of the waveform signal is increased or weighted as described below. As an example, a suitable supplemental RF waveform signal generating means, such as the supplemental RF waveform signal generator 152 schematically represented in FIG. 1 and any associated circuitry, may be utilized to generate and apply the ion isolation waveform signals. The supplemental RF waveform signal generator 152 may be controlled by any suitable electronic or computer controlling means, such as the electronic controller 144 schematically represented in FIG. 1, to generate an ion isolation signal having a waveform appropriate for the experiment being performed. The various hardware, firmware, and/or software components employed to generate the ion isolation waveform signals may operate as part of a mass spectrometry system such as the MS apparatus 100 described above and illustrated in FIG. 1.

Examples of ion isolation waveform signals generated according to the present disclosure will now be described in conjunction with FIGS. 2-6. FIGS. 2-6 are traces of ion isolation waveform signals in the frequency domain. In each of FIGS. 2-6, the abscissa represents the respective frequency values $F_{j1}$ of individual signal components (frequency component signals) of the composite waveform signal in either Hz or kHz and, the ordinate represents the absolute values of the respective amplitudes $|v1_{j1}|$ of the frequency components on a normalized scale. In the following descriptions of ion isolation waveform signals, like reference numerals designate like features of the waveform signal.

Figure 2:
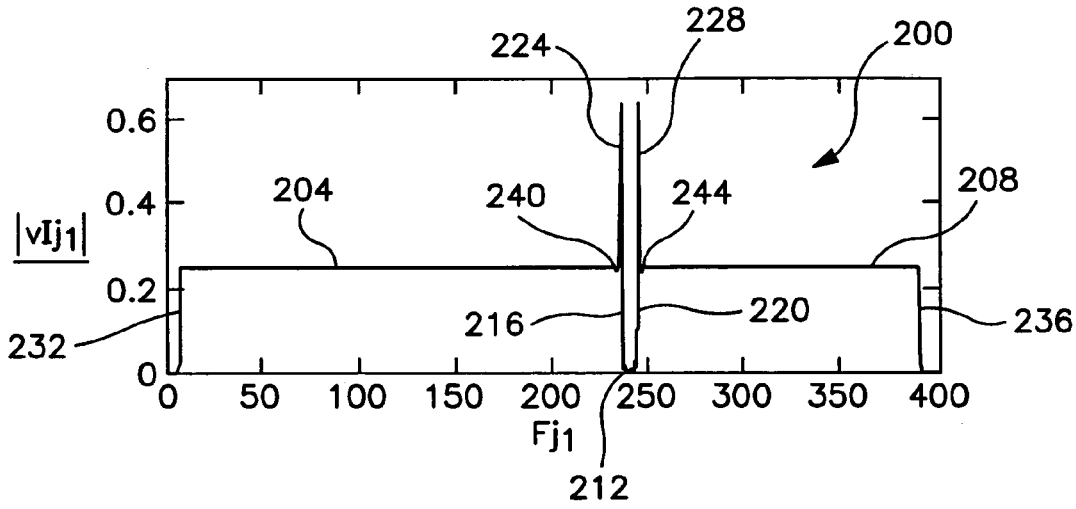
FIG. 2 is a plot in frequency domain of an example of an ion isolation signal generated in accordance with the present disclosure.

FIG. 2 illustrates one example of an ion isolation signal 200 generated in accordance with the principles disclosed herein. In this implementation, the ion isolation signal 200 is a notch broadband waveform signal. The ion isolation signal 200 generally includes a lower frequency band 204, an upper frequency band 208, and a notch band 212 separating (or interposed between) the lower and upper frequency bands 204 and 208. The ion isolation signal 200 may be generated from an ensemble or mixture of discrete signal components (frequency component signals or frequency components), with each signal component being characterized by a particular frequency value and amplitude value. The parameters of the signal components are selected such that, in a given implementation, at least some of the signal components will correspond to (i.e., coincide with or be close to) the secular frequencies required to eject all undesired ions of differing m/z ratios that are present in the ion trap. Moreover, the frequency domain covered by the ion isolation signal 200 is wide enough to cover the corresponding m/z ratios of all ions residing in the ion trap, so that the ion isolation signal 200 is able to eject all ions residing in the ion trap at the time of application of the ion isolation signal 200. The notch band 212 spans a frequency window between a first or lower notch band edge 216 and a second or upper notch band edge 220. The notch band 212 may be narrow in comparison to the lower frequency band 204 and the upper frequency band 208. In a given implementation, the secular frequency or frequencies corresponding to the m/z ratios of the desired ion or ions for which isolation in the ion trap is sought fall within the notch band 212 such that, under proper operating conditions, the ion isolation waveform signal 200 does not resonantly excite the desired ion or ions into ejection from the ion trap. If desired, the notch band 212 may be wide enough to isolate a plurality of desired ions having a range of different m/z ratios.

With continuing reference to FIG. 2, the ion isolation signal 200 includes a first signal component 224 generally positioned at (i.e., generally coinciding with or lying near) the first notch band edge 216 and a second signal component 228 generally positioned at the second notch band edge 220. Stated differently, the first component 224 has a first frequency at (i.e., at or near) the first notch band edge 216, and the second component 228 has a second frequency at (i.e., at or near) the second notch band edge 220. The lower frequency band 204 spans generally from a lowest frequency component signal 232 of the ion isolation signal 200 to the first component 224. The upper frequency band 208 spans generally from the second component 228 to a highest frequency component signal 236 of the ion isolation signal 200. The frequencies of the first and second components 224 and 228 generally correspond to (i.e., are equal to or approximate) the secular frequencies of ions neighboring the desired ion with respect to the m/z value, typically within a few m/z units (atomic mass unit amu, or Dalton Da). In a typical implementation, the frequency of the first component 224 generally corresponds to the secular frequency of the ion whose m/z ratio is closest to, but greater than, the desired ion, and the frequency of the second component 228 generally corresponds to the secular frequency of the ion whose m/z ratio is closest to, but less than, the desired ion. For a desired ion M, the ions closest (nearest or next) to the desired ion may be one Da away from the desired ion (M+/−1 ions). More generally, however, these neighboring, undesired ions may be one or more Da away from the desired ion (M+/−j ions, where j=1, 2, 3, . . . , or more typically j=1, 2, or 3).

In the ion isolation signal 200 of FIG. 2, the amplitudes of one or more of the signal components next to the notch band edges 216 and 220 (such as the first and second components 224 and 228) are weighted (increased). These edge-located components are weighted so that, during application of the ion isolation signal 200 in an ion isolation step, more power is available for ejecting those ions (M+/−j) that are closest in m/z ratio to the desired ion M that is to remain isolated in the ion trap. In this manner, the average power of the entire isolation signal 200 can be reduced while maintaining proper effective notch band width and good mass resolution, as compared for example to waveform signals of the prior art in which equal amplitudes are arbitrarily assigned to all frequency components including the first and second components 224 and 228. In this example, the weighted frequency components include at least the first and second components 224 and 228. As noted previously, the weighted amplitudes are only needed where the undesired ions have m/z ratios near the m/z ratio of the desired ion. As a general matter, the smaller the difference is in m/z ratios between the desired and undesired ions, higher the weight factor should be. As one specific example, when the drive frequency of the trapping field is around 780 kHz and the q value of the desired ion (a well-known Mathieu parameter associated with ion traps) is around 0.75, a weighted amplitude covering about 1-2 Da is sufficient to ensure that the ion isolation signal 200 effectively isolates the desired ion from the closest undesired ion.

As evident from FIG. 2, the weighted amplitudes of the frequency components selected for weighting are greater than the amplitudes that these selected frequency components would have without such weighting. In some implementations, the amplitude of a weighted frequency component is at least greater than the amplitude of one or more adjacent or proximal frequency components located in the same frequency band. For example, the amplitude of the first component 224 may be greater than the amplitude of an adjacent or proximal signal component 240, and the amplitude of the second component 228 may be greater than the amplitude of an adjacent or proximal signal component 244.

In other implementations, the weighted amplitudes are greater than the amplitudes of the rest of the frequency components (i.e., the unweighted frequency components) of the ion isolation signal 200—or, at least, the weighted amplitudes of one or more components at the first notch band edge 216 are greater than the rest of the frequency components of the lower frequency band 204, and the weighted amplitudes of one or more components at the second notch band edge 220 are greater than the rest of the frequency components of the upper frequency band 208. In some implementations, the amplitudes of the frequency components other than the weighted frequency components (i.e., the unweighted frequency components) are equal or substantially equal to each other. In other implementations, the amplitudes of the unweighted frequency components are not all equal to each other. In either case, all of the amplitudes of the unweighted frequency components are significantly less than the amplitudes of the weighted frequency components because, as previously noted, not as much power is needed to eject undesired ions having m/z ratios farther away from the desired ion than the closest undesired ions (M+/−j). In these implementations, the increased magnitudes of the weighted amplitudes may be characterized as being higher relative to the average amplitude of the rest of the frequency components—or at least higher relative to the average amplitude of the rest of the frequency components in the same frequency band 204 or 208 as the particular weighted frequency component being referred to.

In some implementations, the increased magnitudes of the weighted amplitudes are higher than the unweighted amplitudes of the ion isolation signal 200 by a factor greater than 1 (for example, 1.1). In other implementations, the increased magnitudes are higher by a factor of about 2 or greater. In other implementations, the increased magnitudes are higher by a factor ranging from about 1 (for example, 1.1) to 6. In other implementations, the increased magnitudes are higher by a factor ranging from about 2 to 3.5.

Figure 3:
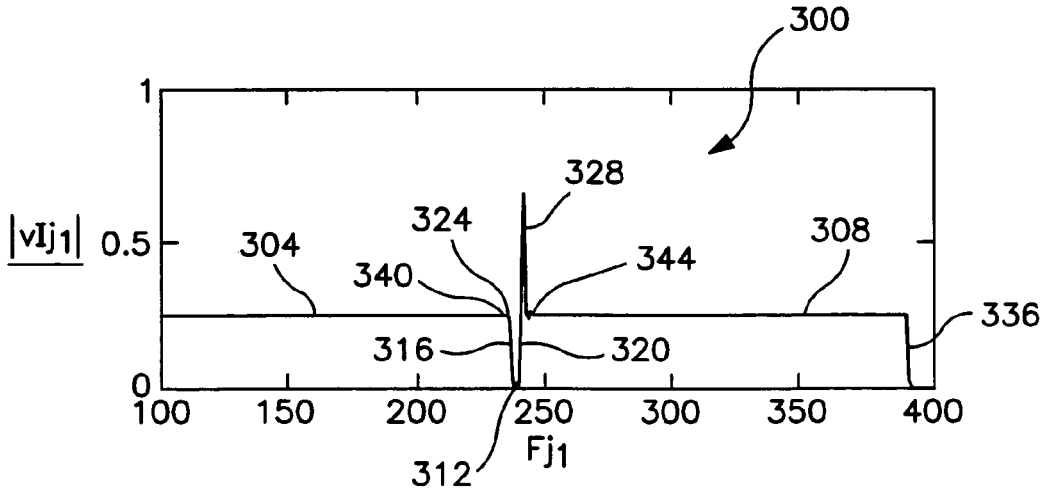
FIG. 3 is a plot in frequency domain of another example of an ion isolation signal generated in accordance with the present disclosure.

FIG. 3 illustrates another example of a notch broadband ion isolation waveform signal 300 generated in accordance with the principles disclosed herein. The ion isolation signal 300 in FIG. 3 is similar to the ion isolation signal 200 in FIG. 2, the primary difference being that a signal component or set of signal components having frequencies at only one of the notch band edges 316 or 320 in FIG. 3 is weighted. The first notch band edge 316 may be weighted to provide higher power for ejecting an undesired ion or ions adjacent to and on the high-mass side of the desired ion or, as illustrated in FIG. 3, the second notch band edge 320 may be weighted to provide higher power for ejecting an undesired ion or ions adjacent to and on the low-mass side of the desired ion.

Relative to the respective amplitudes, or average amplitude, of the other signal components of the ion isolation signal 300 illustrated in FIG. 3, the amplitude of the signal component at the first notch band edge 316 or second notch band edge 320 of this notch signal 300 may be increased by a factor within one of the ranges described above in conjunction with the ion isolation signal 200 illustrated in FIG. 2.

Figure 4:
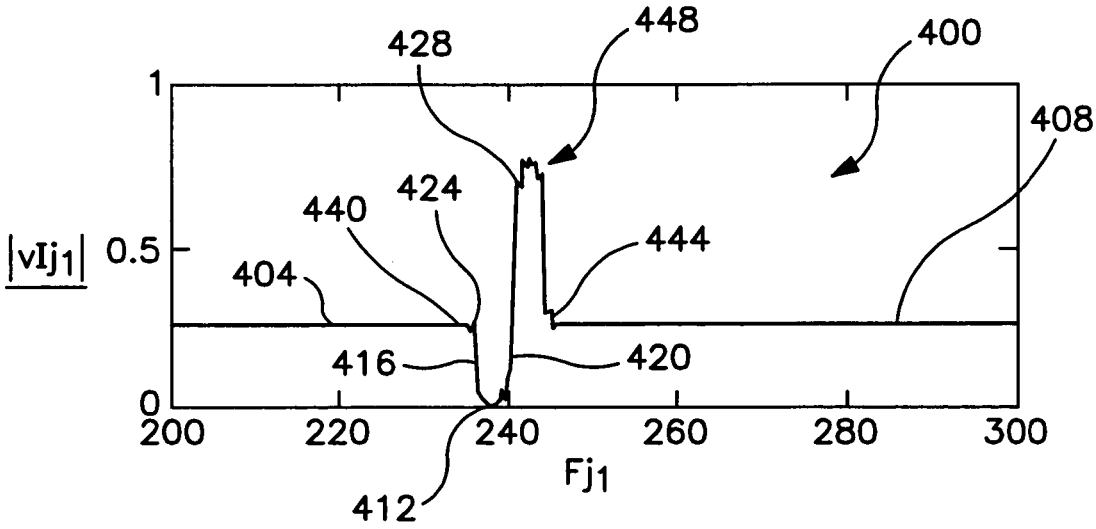
FIG. 4 is a plot in frequency domain of another example of an ion isolation signal generated in accordance with the present disclosure.

FIG. 4 illustrates another example of a notch broadband ion isolation waveform signal 400 generated in accordance with the principles disclosed herein. In the ion isolation signal 400 of FIG. 4, a group or set of signal components having frequencies near one or both of the notch band edges 416 and 420 is weighted instead of just a single component being weighted such as the first component 424 or the second component 428. In the specific example illustrated in FIG. 4, only the set 448 of components near the second notch band edge 420 is weighted, and this set 448 includes the second component 428. The respective weightings applied to the components of this set 448 may be all the same, or the weighting applied to one or more of these components may be different from the weighting applied to the other weighted components of the set 448. Depending on such factors as q, m/z ratio, frequency interval, and other factors, the set 448 of multiple weighted frequency component signals may be utilized to eject undesired ions of a single m/z ratio (e.g., M+/−1) or undesired ions of multiple m/z ratios (e.g., M+/−1, M+/−2, M+/−3). In the case of ejecting a single-mass ion, the application of multiple weighted frequency component signals may be useful because of instrument-related conditions (such as mechanical or electrical imperfections), the number of ions in the ion trap, space-charge effects, and the like. Such conditions may result in the actual secular frequency required to eject an ion of a given mass deviating from the secular frequency expected or calculated for that ion. Relative to the magnitudes or average magnitude of the other signal components of the ion isolation signal 400 illustrated in FIG. 4, the magnitudes of the signal components selected for weighting in this ion isolation signal 400 may be increased by factors within one of the ranges described above in conjunction with the ion isolation signal 200 illustrated in FIG. 2.

Figure 5:
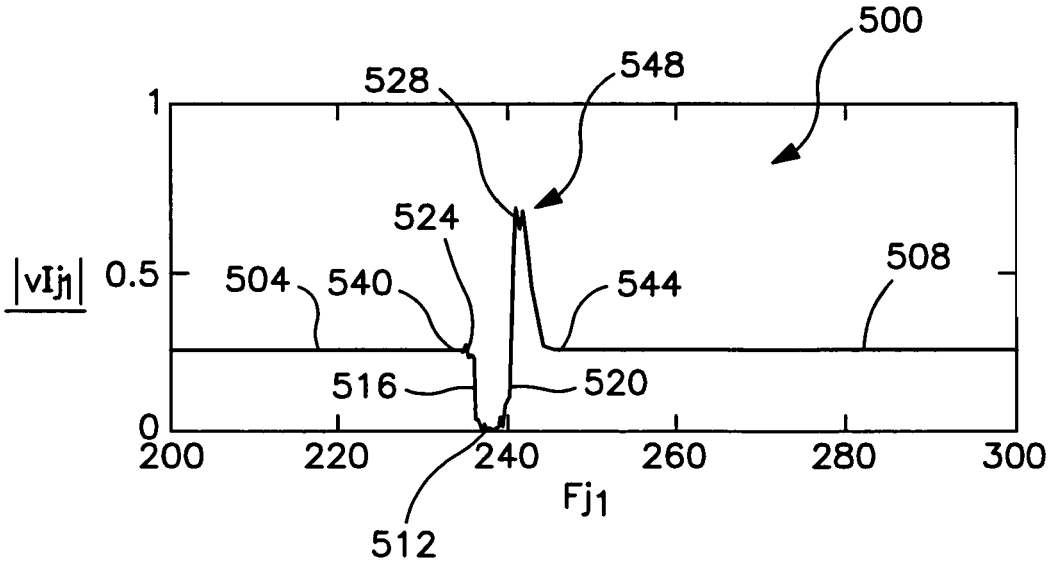
FIG. 5 is a plot in frequency domain of another example of an ion isolation signal generated in accordance with the present disclosure.

FIG. 5 illustrates another example of a notch broadband ion isolation waveform signal 500 generated in accordance with the principles disclosed herein. The ion isolation signal 500 in FIG. 5 is similar to the ion isolation signal 400 in FIG. 4, the primary difference being that the multiple frequency component signals of a set to be weighted near one or both of the notch band edges 516 and 520 are weighted differently in that set. That is, at least one of the weighted frequency components of the set is weighted by a different factor than the other frequency components of the same set. In the specific example illustrated in FIG. 5, only the set 548 of frequency components near the second notch band edge 520 is weighted, and this set 548 includes the second component 528. In implementations where both notch band edges 516 and 520 are weighted, the frequency components weighted at the first notch band edge 516 may be weighted differently from the frequency components weighted at the second notch band edge 520. That is, at least one of the frequency components weighted at the first notch band edge 516 may be weighted by a different factor than at least one of the frequency components weighted at the second notch band edge 520. Relative to the magnitudes or average magnitude of the other frequency components of the ion isolation signal 500 illustrated in FIG. 5, the magnitudes of the frequency components selected for weighting in this ion isolation signal 500 may be increased by factors within one of the ranges described above in conjunction with the ion isolation signal 200 illustrated in FIG. 2.

In the ion isolation signals described above, including those signals 200, 300, 400 and 500 exemplified in FIGS. 2-5, the weighting of the selected amplitudes may be accomplished by any suitable means. In some implementations, for example, the weighting is accomplished by selecting the frequency components that are to be weighted and multiplying the amplitudes of these selected frequency components by a desired weight factor. Thus, in some implementations, the value of the weight factor may be greater than 1 (for example, 1.1). In other implementations, the value of the weight factor may be about 2 or greater. In other implementations, the value of the weight factor may range from about 1 (for example, 1.1) to 6. In other implementations, the value of the weight factor may range from about 2 to 3.5.

In other implementations, the frequency spectrum of the ion isolation signal is created by two or more signals instead of a single composite waveform signal. In these other implementations, the weighting is accomplished by applying an unweighted notch broadband waveform signal and also applying, either simultaneously or sequentially, one or more additional signals having the frequencies selected for weighting. The amplitudes of these signals at the selected frequencies are greater than the amplitudes of the component signals of the notch broadband signal, or the average amplitude of the frequency bands of the notch waveform signal, by an appropriate factor, which may fall within one of the ranges set forth above. In these other implementations, the resultant, combined isolation signal may be similar to one of the signals 200, 300, 400, or 500 illustrated in FIGS. 2-5 or their variations described above.

Figure 6:
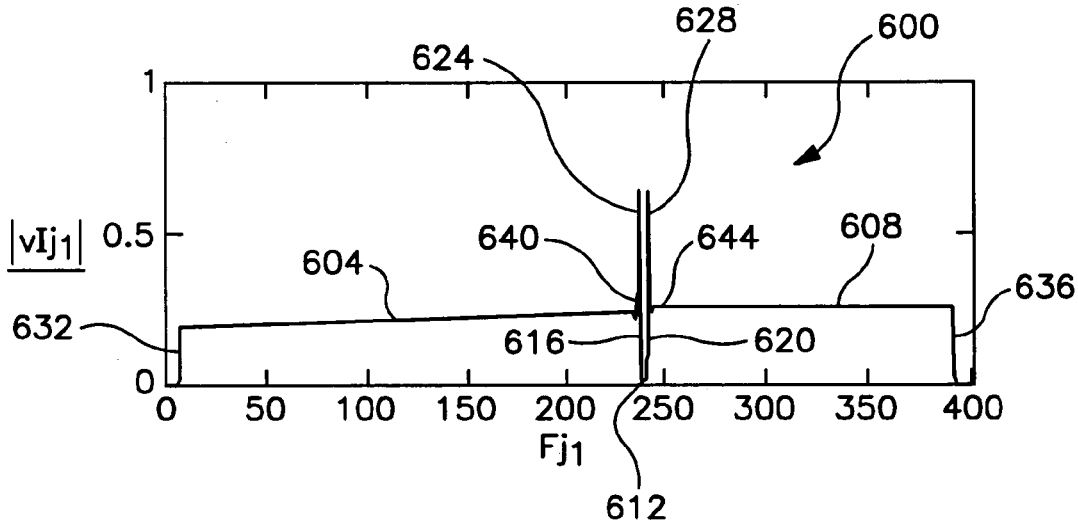
FIG. 6 is a plot in frequency domain of another example of an ion isolation signal generated in accordance with the present disclosure.

FIG. 6 illustrates another example of a notch broadband ion isolation waveform signal 600 generated in accordance with the principles disclosed herein. In this ion isolation signal 600, the amplitudes of one or more of the frequency components at the first notch band edge 616 and/or the second notch band edge 620 are weighted in a manner similar to one of the ion isolation signals 200, 300, 400, or 500 illustrated in FIGS. 2-5 or their variations described above. Additionally in this ion isolation signal 600, the respective amplitudes of the unweighted frequency components in the lower frequency band 604 and/or the upper frequency band 608 are not all equal to each other but instead vary. However, each of the respective amplitudes of the unweighted frequency components is significantly lower than the amplitudes of the weighted frequency components. This is because, as in the case of the other isolation signals described above, the unweighted frequency components are utilized to match the secular frequencies of ions having m/z ratios farther away than the m/z ratios of the ions nearest to the desired ion, and these more remote ions do not require as much power to be ejected from an ion trap for the purpose of isolating the desired ion or ions in the ion trap.

In the example specifically illustrated in FIG. 6, the amplitudes of the frequency components in the lower frequency band 604 vary according to a linear or monotonic relation, which may be useful in certain experiments. More specifically, the amplitudes of the frequency components in the lower frequency band 604 are scaled in inverse proportion to the m/z values of the ions intended to be resonantly excited by these frequency components. Stated differently, for the frequency components in the lower frequency band 604, $A_{m/z}$ is proportional to 1/(m/z). A more detailed description of an example of a technique for providing amplitudes inversely proportional to the m/z values of undesired ions is provided in U.S. Pat. No. 5,300,772, commonly assigned to the assignee of the present disclosure. As set forth in U.S. Pat. No. 5,300,772, for ions ranging from an m/z value of i to an m/z value of n, the scaled amplitudes of the frequency components utilized to eject these ions may be determined from the following relation:

$$\frac{\text{Amplitude for ion } i}{\text{Amplitude for ion } n} = \frac{(\text{mass of ion } n/\text{charge of ion } n)^x}{(\text{mass of ion } i/\text{charge of ion } i)^x},$$

where $1.5 \geqq x \geqq 0.5$. This type of relation has been found particularly useful for ejecting ions having higher m/z ratios than the desired ion, and especially for ejecting ions derived from background environmental air gases. Thus, in the example illustrated in FIG. 6, the weighting according to the inverse relation with m/z ratio is applied to the lower frequency band 604, it being understood that the secular frequencies of ions are approximately inversely related to their m/z ratios.

The notch broadband waveform signal that forms the basis for the improved isolation signals disclosed herein, including those illustrated by way of example in FIGS. 2-6, may be generated by any suitable means. As one example, the notch broadband signal may be generated by a suitable signal generator such as the supplemental RF waveform signal generator 152 depicted in FIG. 1, processed through a bandpass filter to pass a selected spectrum of frequency component signals, and then processed through a band-rejection filter to create the notch band and in effect remove any frequency component signals corresponding to the secular frequency or frequencies of the desired ion or ions. The notch broadband signal may also be created from two non-overlapping broadband signals that are applied either simultaneously or sequentially. The selection of frequency component signals whose amplitudes are to be increased (or weighted) and the values of the increased (or weighted) amplitudes may be dictated by a computer data file as part of a process for controlling the supplemental RF waveform signal generator 152.

It will also be understood that the notch broadband waveform signal according to any of the relevant implementations described herein may include more than one notch band. In such a case, the multi-notch broadband waveform signal would include one or more intermediate frequency bands available for ejecting undesired ions in addition to a lowermost frequency band and an uppermost frequency band. A multi-notch broadband waveform signal is useful for isolating desired ions that fall into two or more different mass ranges.

In other implementations according to the present disclosure, the ion isolation waveform signal is a broadband signal but does not include a notch band. One or more frequency components nearest to the secular frequency associated with the desired ion are weighted as described in the present disclosure, but only on the low-mass or high-mass side of the desired ion. In other words, instead of applying a notch broadband waveform signal as in the implementations described thus far, the broadband signal employed for isolation in effect includes only a lower frequency band or upper frequency band on one side of the secular frequency of the desired ion. In such implementations, the broadband signal operates to eject either the M+j ions and other undesired ions having m/z values higher than that of the desired ion or the M−j ions and other undesired ions having m/z values lower than that of the desired ion. Accordingly, this ion isolation signal may be employed in conjunction with another technique for ejecting all other undesired ions.

As an example, in U.S. Pat. No. 5,198,665, commonly assigned to the assignee of the present disclosure, the complete isolation of desired ions is achieved by implementing two steps. In the first step, the ions having m/z ratios less than or equal to M−1 are sequentially ejected by a combination of scanning and resonant excitation in a known manner. For instance, a supplemental AC voltage may be applied at a fixed frequency to a pair of opposing electrodes of the ion trap. While the supplemental AC voltage is being applied, the amplitude of the fundamental voltage of the RF trapping field is ramped from a lower magnitude to a higher magnitude, thereby causing ions of successive m/z ratios to be ejected as their secular frequencies match up with the fixed frequency of the supplemental AC signal. In the second step, the ions having m/z ratios greater than or equal to M+1 are ejected by application of a broadband waveform signal that includes the frequency components required to resonantly eject these higher-mass ions. Depending on the composition of this broadband signal, the magnitude of the fundamental voltage of the RF trapping field may be held constant or may be ramped down during application of the broadband signal. In accordance with the present implementation, a two-step process such as described in U.S. Pat. No. 5,198,665 may be improved by employing, in the second step, a broadband signal that includes selected weighted frequency components—that is, by weighting one or more of the frequency components nearest to the secular frequency associated with the desired ion as described above. In the specific example just described, the frequency component or components employed to eject the M+1 ion, or the group of frequency components employed to eject the M+j ions, are weighted relative to the other frequency components of the broadband signal.

As a general matter, the ion isolation signals described above, including those illustrated by way of example in FIGS. 2-6, may be generated by any suitable digital or analog means known to persons skilled in the art. The distances in frequency domain between neighboring frequency component signals may be all be equal to each other or may be unequal. It will be noted that in practice the secular frequency distribution of ions in an ion trap is typically non-uniform. Thus, each frequency component signal may not correspond to an exact nominal-mass ion. Furthermore, depending on digital resolution (i.e., the size of the frequency interval), the number of total frequency component signals in a specified frequency range may be varied. Finally, depending on the experiment being performed, the type of waveform of the ion isolation signal being applied, the mass range or composition of the trapped ion, or other factors, it may be desirable to scan an operating parameter of the trapping field, such as the amplitude of the drive voltage, during application of the ion isolation signal.

Figure 7:
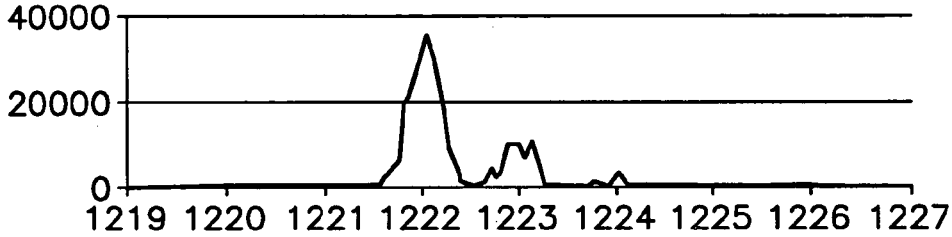
FIG. 7 PRIOR ART
FIG. 7 illustrates a mass spectrum of a mass-analyzed sample without the application of an ion isolation signal.
Figure 8:
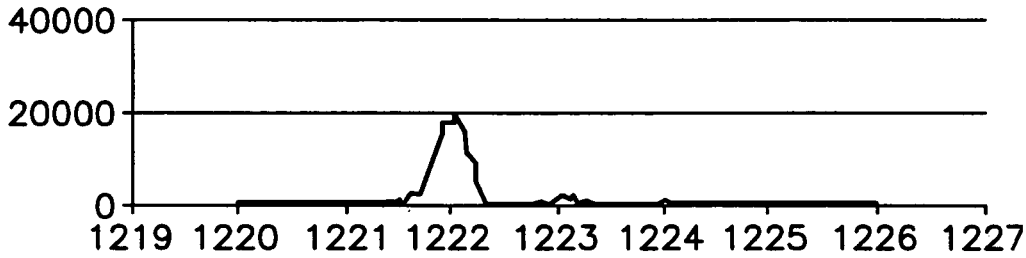
FIG. 8 PRIOR ART
FIG. 8 illustrates a mass spectrum of the mass-analyzed sample of FIG. 7, but after applying a notch broadband ion isolation signal of the prior art.
Figure 9:
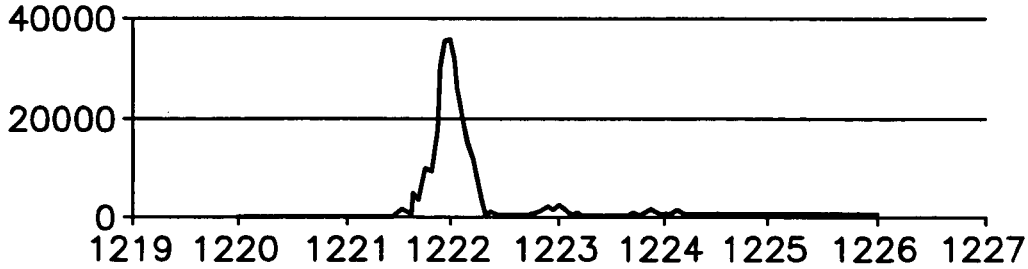
FIG. 9 illustrates a mass spectrum of the mass-analyzed sample of FIG. 7, but after applying an ion isolation signal of the type described in the present disclosure.

The improvement in the performance of an ion storage apparatus when employing the improved ion isolation signals disclosed herein is evident from a comparison of the mass spectra illustrated in FIGS. 7-9. FIGS. 7-9 illustrate mass spectra obtained from a sample material analyzed by employing a three-dimensional quadrupole ion trap mass spectrometer, an example of which is described above in conjunction with FIG. 1. In each of FIGS. 7-9, the abscissa represents the m/z ratios of ions detected by the mass spectrometer and the ordinate represents the relative abundances (for example, ion count or intensity of ion flux) of the detected ions. The ion for which isolation is desired has an m/z ratio of 1222.

FIG. 7 illustrates the mass spectrum resulting from a mass analysis performed without the application of an ion isolation signal. It can be seen that a significant number of M+1 ions (in this case, m/z=1223) are present along with the desired M ion (in this case, m/z=1222). FIG. 8 illustrates the mass spectrum resulting from a mass analysis performed after applying a notch broadband waveform signal of the prior art. It can be seen that while the desired M ions have been better isolated from the M+1 ions as well as all other undesired ions, nearly half of the desired M ions have been lost as a result of the isolation process. That is, an unacceptable number of M ions have been ejected along with the undesired ions, and therefore the mass resolution is considered to be poor. Finally, FIG. 9 illustrates the mass spectrum resulting from a mass analysis performed after applying a notch broadband waveform signal generated similarly to that illustrated in FIG. 2 or 3. In FIG. 9, not only have the desired M ions been effectively isolated from the M+1 ions and all other undesired ions, but also all or at least the majority of the desired M ions have been successfully retained in the ion trap as intended. That is, as a result of applying an ion isolation signal as described in the present disclosure, all or at least the majority of the undesired M+1 ions and all other undesired ions have been ejected while no or at least few of the desired M ions have been ejected.

Figure 10:
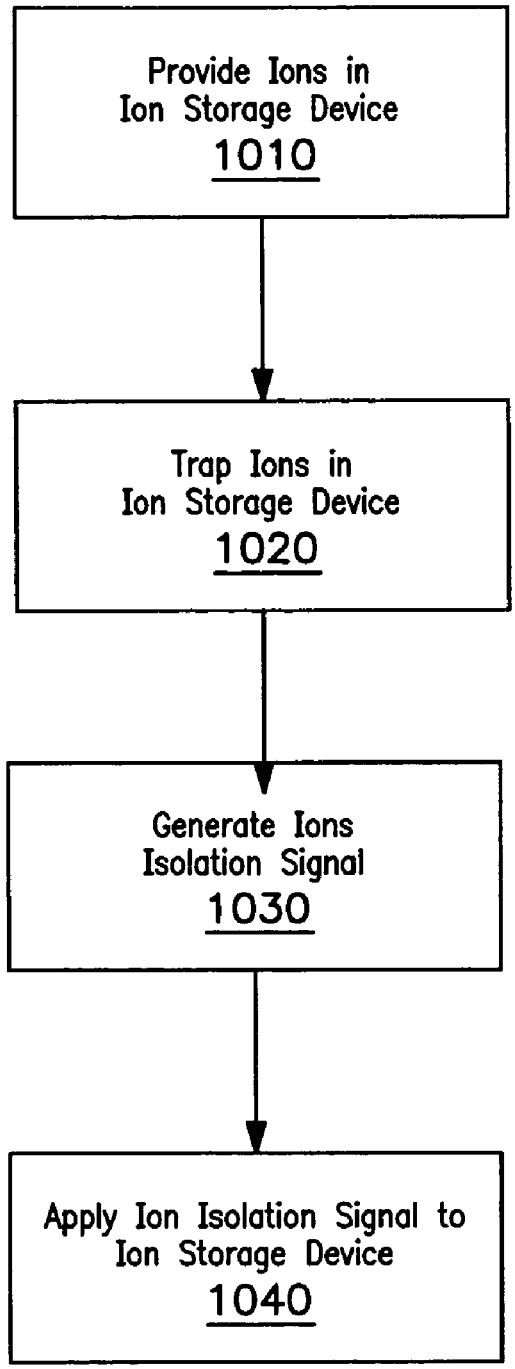
FIG. 10 is a flow diagram illustrating examples of implementing ion isolation signals described in the present disclosure.

FIG. 10 illustrates examples of methods for isolating one or more desired ions of a selected mass, range of masses, or ranges of masses in a volume, such as the interior of an ion trap or storage device. In one implementation, at block 1040, an ion isolation signal according to any of the implementations described in this disclosure is applied to an ion storage device. In another implementation, at block 1030, the ion isolation signal is generated and, at block 1040, the generated ion isolation signal is applied to the ion storage device. In another implementation, at block 1020, ions are trapped in the ion storage device and, at block 1040, the ion isolation signal is applied to the ion storage device. The ions may be trapped by applying a suitable ion trapping signal to the ion storage device such that motions of the ions are constrained to an ion trapping volume in the ion storage device. In another implementation, at block 1010, ions are provided in the ion storage device such as by being introduced into or formed in the ion storage device by external or internal ionization means.

According to other implementations, an apparatus is provided that includes an electrode arrangement that has an interior. The apparatus may include an ion trap or storage device that defines the interior. The apparatus may further include means for applying an ion isolation signal according to any of the implementations described in this disclosure. Generally, the apparatus may include means for implementing any of the methods described in this disclosure, including any of the methods described above in conjunction with FIG. 10. In some implementations, the apparatus may operate in conjunction with or as part of an analytical instrument such as, for example, the mass spectrometer or mass spectrometry system described above and illustrated in FIG. 1.

It will be understood that the ion isolation signals, methods, and apparatus described in the present disclosure may be implemented in an MS system as generally described above and illustrated in FIG. 1 by way of example. The present subject matter, however, is not limited to the specific MS apparatus 100 illustrated in FIG. 1 or to the specific arrangement of circuitry illustrated in FIG. 1. Moreover, the present subject matter is not limited to MS-based applications.

The subject matter described in the present disclosure may also find application to ion traps that operate based on Fourier transform ion cyclotron resonance (FT-ICR), which employ a magnetic field to trap ions and an electric field to eject ions from the trap (or ion cyclotron cell). The subject matter may also find application to static electric traps such as described in U.S. Pat. No. 5,886,346. Apparatus and methods for implementing these ion trapping and mass spectrometric techniques are well-known to persons skilled in the art and therefore need not be described in any further detail herein.

It will also be understood that the subject matter described in the present disclosure may be applied in conjunction with tandem MS (MS/MS) applications and multiple-MS (MS″) applications. For instance, ions of a desired m/z range can be trapped, isolated as "parent" or "precursor" ions, and subjected to collision-induced dissociation (CID) by well-known means using a suitable background gas (for example, helium) for colliding with the isolated ions. The resulting "daughter," "fragment," or "product" ions can then be mass analyzed, and the process can be repeated for successive generations of ions. Generally, MS/MS and MS″ applications are well-known to persons skilled in the art and therefore need not be described in any further detail herein.

It will also be understood that the periodic voltages applied in implementations described in the present disclosure are not limited to sinusoidal waveform signals. As a general matter, the principles taught herein may be applied to other types of periodic waveform signals such as triangular (saw tooth) waves, square waves, and the like.

It will be further understood that various aspects or details of the invention may be changed without departing from the scope of the invention. Furthermore, the foregoing description is for the purpose of illustration only, and not for the purpose of limitation—the invention being defined by the claims.

What is claimed is:

1. A method for isolating a desired ion in an ion trapping volume, the method comprising the step of:

applying an ion isolation signal to a plurality of ions in an ion trapping volume, the plurality of ions including a desired ion to be retained in the ion trapping volume and an undesired ion to be ejected from the ion trapping volume, wherein:

the ion isolation signal includes a plurality of signal components spanning a frequency range, the plurality of signal components includes a first signal component having a frequency near a secular frequency of the desired ion, and an adjacent signal component having a frequency adjacent to the frequency of the first signal component relative to the other signal components; and the first signal component has an amplitude greater than the amplitude of the adjacent signal component by a factor ranging from about 1.1 to 6.

2. The method of claim 1, wherein the factor ranges from about 2 to 3.5.

3. The method of claim 1, wherein the plurality of ions includes a plurality of undesired ions, the plurality of undesired ions includes a first undesired ion having an m/z ratio nearest to the m/z ratio of the desired ion relative to the other undesired ions, and the frequency of the first signal component is at least approximately equal to a secular frequency of the first undesired ion.

4. The method of claim 1, wherein the plurality of signal components includes a first set of signal components having a first set of frequencies nearest to the secular frequency of the desired ion relative to the frequencies of the other signal components, the first set of signal components includes the first signal component, the frequency of the adjacent signal component is adjacent to at least one of the first set of frequencies, and each of the signal components of the first set has an amplitude greater than the amplitude of the adjacent signal component by the factor.

5. The method of claim 4, wherein the respective amplitudes of the components of the first set are the same.

6. The method of claim 4, wherein the amplitude of at least one of the components of the first set differs from the respective amplitudes of the other components of the first set.

7. The method of claim 1, comprising the step of scanning a trapping field being applied to the ion trapping volume while applying a fixed-frequency excitation signal to the ion trapping volume to eject undesired ions having m/z ratios less than the m/z ratio of the desired ion from the ion trapping volume, wherein applying the ion isolation signal ejects undesired ions having m/z ratios greater than the m/z ratio of the desired ion from the ion trapping volume.

8. A method for isolating a desired ion to be retained in an ion trapping volume while ejecting undesired ions from said ion trapping volume, the method comprising the steps of:

admitting a plurality of ions to an ion trapping volume, the plurality of ions including a desired ion to be retained in the ion trapping volume and an undesired ion to be ejected from the ion trapping volume;

composing a broadband ion isolation signal comprising a plurality of signal components spanning a frequency range, the frequency range including a lower frequency band, an upper frequency band, and a notch band separating the lower frequency band and the upper frequency band;

the plurality of signal components includes a first signal component having a first frequency near a secular frequency of the desired ion, outside the notch band and at an edge of the notch band, and an adjacent signal component having an adjacent frequency in the same frequency band as the first frequency and adjacent to the first frequency relative to the other signal components in the same frequency band; and the first signal component having an amplitude greater than the amplitude of the adjacent signal component by a desired factor; and applying said ion isolation signal to said ion trapping volume.

9. The method of claim 8, wherein the amplitude of the first signal component is greater than the average amplitude of the other signal components in the same frequency band as the first signal component.

10. The method of claim 8, wherein the amplitude of the first signal component is greater than the amplitude of the adjacent signal component by a factor ranging from about 1.1 to 6.

11. The method of claim 8, wherein the first frequency is in the lower frequency band.

12. The method of claim 8, wherein the first frequency is in the upper frequency band.

13. The method of claim 8, wherein the plurality of signal components includes a first set of signal components having a first set of frequencies in the same frequency band as each other and on one side of the notch band, the first set of frequencies are nearest to the secular frequency of the desired ion relative to the frequencies of the other signal components of the same frequency band, the first set of signal components includes the first signal component, the adjacent frequency is adjacent to at least one of the first set of frequencies, and each of the signal components of the first set has an amplitude greater than the amplitude of the adjacent signal component.

14. The method of claim 8, wherein:

the first frequency is in the lower frequency band and at a first edge of the notch band;

the plurality of signal components further includes a second signal component having a second frequency near the secular frequency of the desired ion, outside the notch band, at a second edge of the notch band and in the upper frequency band, and a proximal signal component having a proximal frequency in the upper frequency band and adjacent to the second frequency relative to the other signal components in the upper frequency band; and the second signal component has an amplitude greater than the amplitude of the proximal signal component.

15. The method of claim 14, wherein the respective amplitudes of the first signal component and the second signal component are the same.

16. The method of claim 14, wherein the respective amplitudes of the first signal component and the second signal component are different.

17. The method of claim 14, wherein:

the plurality of signal components includes a first set of signal components having a first set of frequencies in the lower frequency band and nearest to the notch band relative to the other signal components of the lower frequency band, the first set of signal components includes the first signal component, the adjacent frequency is adjacent to at least one of the first set of frequencies, and each of the signal components of the first set has an amplitude greater than the amplitude of the adjacent signal component; and the plurality of signal components further includes a second set of signal components having a second set of frequencies in the upper frequency band and nearest to the notch band relative to the other signal components of the upper frequency band, the second set of signal components includes the second signal component, the proximal frequency is adjacent to at least one of the second set of frequencies, and each of the signal components of the second set has an amplitude greater than the amplitude of the proximal signal component.

18. The method of claim 17, wherein the respective amplitudes of the signal components of the first set are the same.

19. The method of claim 17, wherein the amplitude of at least one of the signal components of the first set differs from the respective amplitudes of the other signal components of the first set.

20. The method of claim 17, wherein the respective amplitudes of the signal components of the first set are the same as the respective amplitudes of the signal components of the second set.

21. The method of claim 17, wherein the amplitude of at least one of the signal components of the first set differs from the amplitude of at least one of the signal components of the second set.

22. The method of claim 8, wherein at least one of the lower frequency band and the upper frequency band includes a set of signal components other than the first signal component, and the amplitude of at least one of the signal components of the set is different from the respective amplitudes of the other signal components of the set.

23. The method of claim 22, wherein the respective amplitudes of the signal components of the set are varied from a lowest value to a highest value.

24. An apparatus for isolating a desired ion in an interior, the apparatus comprising:

an electrode structure having an interior, and means for applying an ion isolation signal to the electrode structure to impart an RF excitation field to a plurality of ions in the interior, the plurality of ions including a desired ion to be retained in the interior and an undesired ion to be ejected from interior, wherein:

the ion isolation signal includes a plurality of signal components spanning a frequency range, the plurality of signal components includes a first signal component having a frequency near a secular frequency of the desired ion, and an adjacent signal component having a frequency adjacent to the frequency of the first signal component relative to the other signal components; and the first signal component has an amplitude greater than the amplitude of the adjacent signal component by a desired factor ranging from about 1.1 to 6.

* * * * *